United States Patent [19]

Tosti

[11] Patent Number: 4,878,667

[45] Date of Patent: Nov. 7, 1989

[54] REPLACEABLE, REUSABLE GOLF CLUB GRIP

[76] Inventor: John Tosti, 5727 Buena Vista Dr., Vancouver, Wash. 98661

[21] Appl. No.: 198,060

[22] Filed: May 24, 1988

[51] Int. Cl.[4] ..... A63B 53/14

[52] U.S. Cl. ..... 273/81.2; 273/75; 273/165; 43/22

[58] Field of Search ..... 273/81 R–81 D, 273/194 B, 165, 166, 81.2–81.6, 32 R, 77 R, 75, 67 DB, 68, 67 R, 67 DA, 73 J; 81/489, 177.1; 43/22; 16/114 R, 110 R, DIG. 12, DIG. 19; 292/DIG. 38, 80, 87, 81, 85; 74/543, 551.8, 551.9; 24/456, 487, 580, 588

[56] References Cited

U.S. PATENT DOCUMENTS

| | | | |
|---|---|---|---|
| 621,993 | 3/1899 | Crosier | 273/81 R |
| 1,648,175 | 11/1927 | Hamel et al. | 273/81 R |
| 2,877,018 | 3/1959 | Turner | 273/81.4 |
| 2,994,486 | 3/1961 | Jones | 273/72 |
| 3,087,729 | 4/1963 | Sullivan | 273/81.2 |
| 3,147,012 | 9/1964 | Sullivan, Jr. | 273/165 |
| 3,410,017 | 11/1968 | Wilson | 43/22 |
| 3,544,140 | 12/1970 | Langheck | 273/81.2 |
| 3,606,326 | 9/1971 | Sparks et al. | 273/81 R |
| 4,478,381 | 10/1984 | Pittion et al. | 24/487 |
| 4,662,415 | 5/1987 | Proutt | 150/50 |

FOREIGN PATENT DOCUMENTS

| | | | |
|---|---|---|---|
| 2182252 | 5/1987 | United Kingdom | 273/81 R |

*Primary Examiner*—Edward M. Coven
*Assistant Examiner*—S. Passaniti
*Attorney, Agent, or Firm*—Marger & Johnson

[57] ABSTRACT

A grip for a golf club is readily replaceable without the use of tools to allow changing golf club grips without professional assistance and is reusable subsequent to replacement since it is not damaged on removal from the golf club shaft.

14 Claims, 1 Drawing Sheet

REPLACEABLE, REUSABLE GOLF CLUB GRIP

BACKGROUND OF THE INVENTION

The present invention relates to the field of golf club grips, and more particularly to golf club grips which are readily replaceable and reusable.

Conventional golf club grips usually are made of a flat, elongate strip of fabric, leather or other flexible material is wound around the grip end of a golf club shaft and secured thereon with an adhesive. The grip thus formed is semi-permanent. When it is worn, or a golfer desires to change the grip, it may be removed with difficulty, generally by cutting it and installing a new grip in a similar fashion. Removal of a grip often destroys it so that it is not reusable. Furthermore, because of the need for cutting tools, adhesives and the like, it is inconvenient for a golfer to change a golf club grip himself. Rather, this is conventionally done by a skilled worker in a golf store or pro shop.

Today, the selection of golf club grips is rather limited in style and color. Typically, grips are either brown or black. This sharply limits the ability to differentiate a particular golf club by its grip. Further, limited selection and interchangeability of grips impedes a golfer's ability to select and use grips that coordinate with or complement his or her golf attire. Nor do conventional grips help to distinguish a golfer's clubs from another golfer's club.

Conventional golf club grips exhibit an elongate frustoconical exterior, thickening toward the end of the shaft to provide a larger gripping area as compared to the shaft. The frustoconical shape of a golf club grip is not optimal for golfing performance, however, as it provides no guidance to the golfer to grip the club in the same manner for each use. A pair of grips having a relatively flat surface portion, are shown in U.S. Pat. No. 2,877,018. The grips shown in that patent, however, are permanently secured to the club shaft in the conventional manner. A removable cover directed to drying and protecting a golf club grip when not in use is shown in U.S. Pat. No. 4,662,415. A detachable grip for fishing rods is shown in U.S. Pat. No. 3,410,017.

Accordingly, a need remains for a golf club grip which is easily replaceable on a golf club shaft by golfers without pro shop assistance and may be reusable after removal by the golfer from the golf club. A further need remains for a detachable golf club grip of the type described above which exhibits any of a variety of colors or markings for identifying golf clubs and/or for coordinating with the golfer's garb or other equipment.

SUMMARY OF THE INVENTION

Accordingly, it is an object of the present invention to enable a golfer to readily replace a selected grip on to or off of a golf club as desired without tools and without professional assistance.

It is another object of the present invention to provide a golf club grip which, after replacement, is subsequently reusable on a golf club because it's structural integrity has not be damaged during replacement.

It is a further object of the present invention to provide for a plurality of interchangeable grips of different colors, for coordinating the golfer's clubs with his attire or which may be used to identify a set of clubs or to distinguish particular clubs within a set.

Accordingly, a golf club can now be provided comprising a head for striking a golf ball, an elongate shaft having top and bottom ends connected at the bottom end to the head for moving the head, and a golf club grip, releasably secured to the shaft so as to cover the top end of the shaft and a portion of the shaft adjacent the top end for gripping the shaft. The golf club grip includes two elongate sections pivotally connected together for opening and closing same and locking means for releasably locking the grip in frictional engagement on the shaft. The subject golf club preferably includes a grip formed of an impact-resistant, flexible polymeric material.

The golf club grip per se comprises a pair of elongate sections substantially equal in length. Together these sections define an interior channel sized for engagingly receiving a golf club shaft. Hinge means are connected to each of the elongate sections for pivotally interconnecting the sections. Locking means connected to each the sections for releasably securing the sections in mating relation to each other to lock the grip onto the shaft for forming a unitary golf club grip. Preferably, the golf grip sections are formed of a single piece of an impact-resistant, flexible polymeric material including hinge means integral with the single piece golf grip, the elongate sections together forming a substantially continuous exterior surface of the grip when secured in mating relation. Generally, the golf club grip is fabricated so that it is thinned in a region adjacent the interconnection of the sections to form the hinge means. A typical golf club grip includes locking means having at least one flange positioned along an elongate end of one of the sections and at least one slot means corresponding in number to the number of the flanges. Each slot is disposed in an elongate end opposite the corresponding flange, and is sized and positioned to receive and interlocklingly and releasingly secure the corresponding flange to maintain the grip in position on the shaft and to form a substantially continuous external surface of the grip. The locking means preferably includes a first flange having an L-shaped cross section connected along the end of a first one of the sections and extending outwardly therefrom and a second flange having an L-shaped cross section connected along a corresponding end of the other one of the sections and extending inwardly therefrom. The first flange and the second flange are respectively sized and positioned relative to each other to interlockingly engage each other to releasably secure the sections to each other and form a substantially continuous external surface of the grip. In one form of this invention, the flanges extend along substantially the entire length of the sections.

The golf club grip has certain desirable features including providing the sections so that together they define at least one slot when they are secured in the mating relation with each other. The slot, in this case, is positioned in communication with the locking means and is sized to receive a means, such as a coin and the like, for releasing the locking means. In another feature of the invention, the golf club grip includes sections which are formed to define a substantially flat top end of the grip, and interior channels terminating at a position spaced apart from the top end of the grip so that the grip covers the end of the shaft. The golf club grip can also include sections which are formed to define a pair of substantially flat faces positioned adjacent each other and substantially normal to each other. A plurality of golf club grips can be produced according to this invention which include at least one grip exhibiting a color different from the color of another grip in the set.

In use, the golf club grip of the present invention can be releasably and reusably installed on the shaft of a golf club positioning the grip, in an opened position, on the end of the shaft, closing the grip into a position such that it substantially encompasses the end of the shaft, and locking the grip in frictional engagement with the shaft such that the grip forms a substantially continuous exterior surface. When the grip includes a pair of elongate sections pivotally connected together, each section having an end, the closing step includes pivoting the sections to bring the ends of the sections toward each other, and then locking the grip in position by pressing the ends of the elongate sections together to interconnect them in interlocking engagement. When the sections each including a flange having an L-shaped cross-sectional configuration which extends from an end of the section, the locking step includes moving the respective flanges into interlocking engagement one with the other.

The foregoing and other objects, features and advantages of the invention will become more readily apparent from the following detailed description of a preferred embodiment which proceeds with reference to the drawings.

DETAILED DESCRIPTION OF A PREFERRED EMBODIMENT

Figure 1:
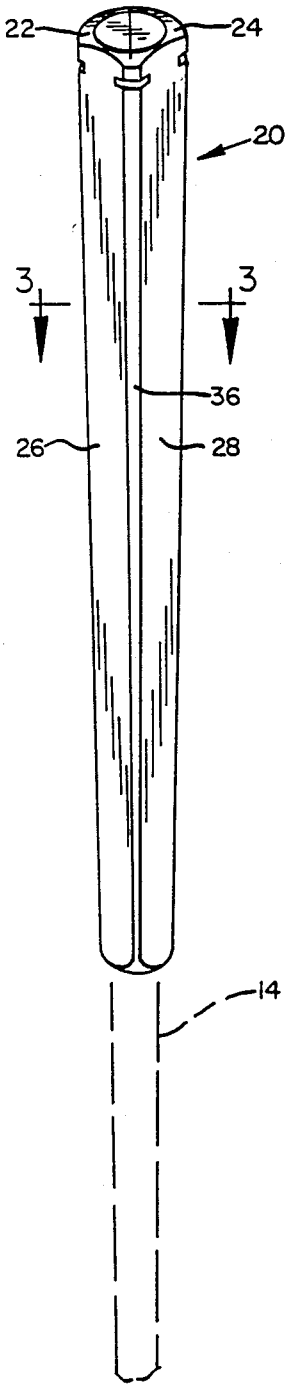
FIG. 1 is a perspective view of a golf club in combination with a golf club grip according to the present invention showing the shaft in phantom.
Figure 2:
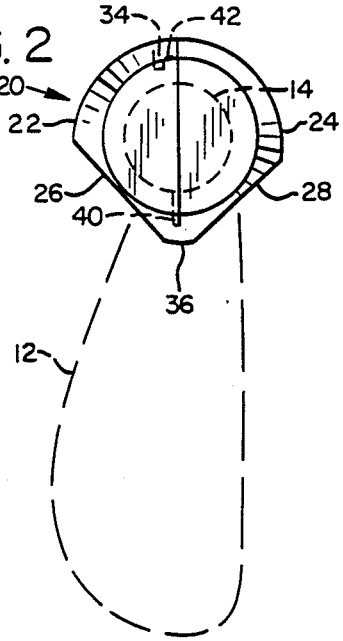
FIG. 2 is a top view of the golf club grip of FIG. 1, showing the club head and shaft in phantom.

Referring now to FIG. 2, a top view of a golf club is shown. The club includes a head 12 connected to a shaft 14. A golf club grip 20 is connected to the top end of the shaft 14. The golf club grip 20 includes two elongate sections, a first section 22, and a second section 24. Referring now to FIGS. 1 and 2, the first section 22 includes a substantially flat face 26 extending along its length. The second section 24 similarly includes a flat face 28 extending along its length. The elongate sections 22 and 24 are positioned with their respective flat faces adjacent and substantially at right angles to each other. The two flat faces 26 and 28 are pivotally joined to form a ridge 36.

Figure 4:
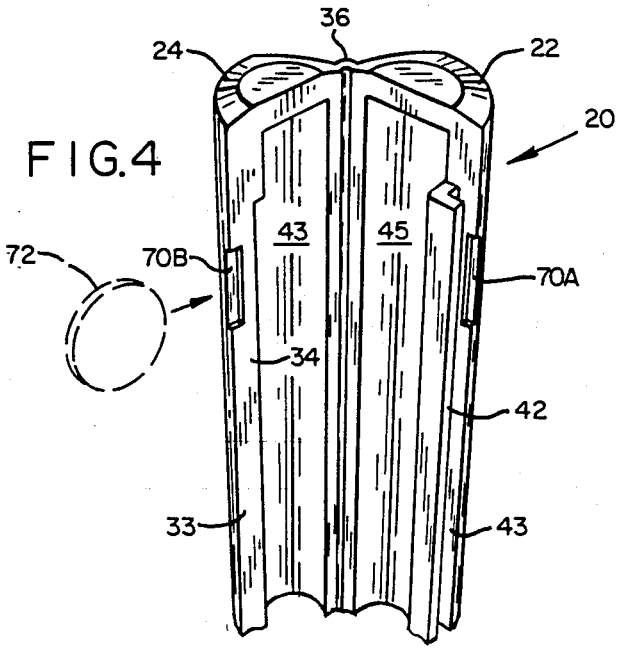
FIG. 4 is an enlarged, sectional perspective view of an upper section of the grip of FIG. 1, showing the grip in an opened position and a coin for unsnapping the grip in phantom.
Figure 5:
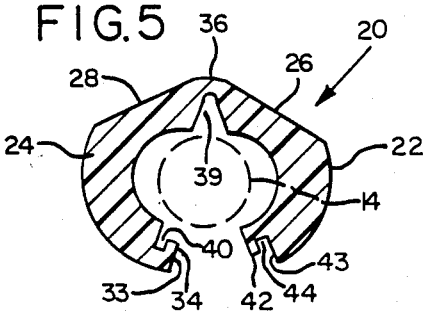
FIG. 5 is the grip of FIG. 3 depicted in an unlocked position, showing the shaft in phantom.

The two elongate sections 22 and 24 preferably are made of a flexible, impact-resistant polymeric material. The use of such materials helps to ensure a snug fit on the shaft 14 and is useful for opening and closing the grip as further explained below. The two elongate sections 22 and 24 are pivotally or hingedly connected together along ridge 36 so that the grip may be opened as shown in FIGS. 4 and 5, for attaching the grip to the shaft 14. Any appropriate hinge apparatus could be employed along ridge 36. Preferably, the two elongate sections 22 and 24 are formed of a single piece of a flexible polymeric material such that the combination merely bends along the ridge 36 for opening the grip.

Figure 3:
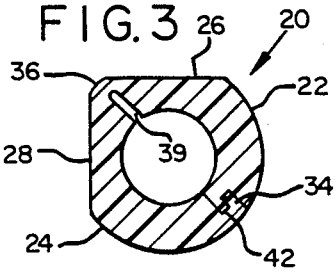
FIG. 3 is a cross-sectional view of the grip of FIG. 1 taken along line 3—3 of FIG. 1, showing the club in phantom.

Referring now to FIG. 3, deformation of the polymeric material required to open the grip is facilitated by providing an interior groove 39 positioned along the interior of the grip adjacent ridge 36. The groove 39 reduces the thickness of the polymeric material along the ridge 36 so that it bends more easily. The groove 39 widens into a V-shaped channel as the grip is opened, as shown in FIG. 5.

The elongate sections 24 and 22 are hollowed out such that their interior surfaces define generally semi-cylindrical grooves 43 and 45. The grooves are sized and shaped to receive the shaft 14 snugly nested therein when the grip is closed. Thus, the grip 20 is maintained in frictional engagement with the shaft 14. The grooves 43 and 45 extend to a position spaced below the top of the grip as shown in FIG. 4, so that the top end of the shaft 14 is covered by the grip 20.

The grip 20 is securely yet removably locked in position on the shaft as follows. Referring to FIGS. 4 and 5, the elongate section 22 defines an end 43 extending axially along the section. A flange 42 having an L-shaped cross section extends from the end 43 and outward, i.e. away from central groove 45.

Similarly, section 24 defines an end 33 extending axially along that section. A flange 34 having an L-shaped cross section extends from the end 33 and inward, i.e. toward the central groove 43. The two flanges are sized and positioned to interlockingly engage one another for releasably securing the two ends of the sections together.

To install the grip, it is positioned over the end of shaft 14 so that the end of the shaft is positioned in either groove 43 or 45. The elongate sections then are pivoted so that edges 33 and 43 are brought together to encompass the shaft. The two elongate sections next are further pressed together so that the flanges 34 and 42 deform and ride over each other until they snap into interlocking engagement in channels 44 and 40, respectively, as shown in FIG. 3. Thus joined, the two sections form a substantially continuous outside surface of the golf club grip. The grip is now securely attached to the shaft.

A pair of recesses 70A and 70B are formed in sections 22 and 24 respectively as shown in FIG. 4, to form a slot. To remove the grip, a coin 72, preferably a quarter, is inserted in the slot and twisted, thereby prying edges 33 and 43 apart from each other. Flanges 34 and 42 consequently disengage from each other, leaving the sections free to be spread further open for easy removal from the shaft 14.

A golfer or other user may then select another grip, and snap it into place on the shaft, as described above. Preferably, several such grips are provided in a variety of colors. Colors may be selected for coordinating with the color of the golfer's garb, or distinguishing among his or her clubs, or distinguishing his clubs from another golfer's clubs.

Figure 6:
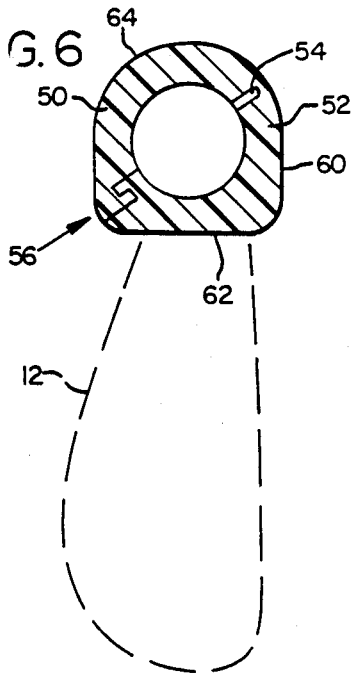
FIG. 6 is a cross-sectional view of an alternative embodiment of a golf club grip according to the present invention, showing the golf club head in phantom.

An alternative embodiment of the invention is shown in FIG. 6. That embodiment includes two elongate sections 50 and 52, similarly formed of a unitary piece of an impact-resistant, flexible polymeric material. As in the above-described embodiment, the polymeric material is thinned in the region where the elongate sections interconnect, thereby defining a groove 54 to facilitate bending along said interconnection region for opening and closing the grip. This embodiment includes interlocking structures 56 as described above for attaching and removing the grip.

In this embodiment, one of the elongate sections, section 52, has an exterior surface defining a pair of substantially flat faces 60 and 62 positioned perpendicular to one another. Elongate section 50 has a generally semi-circular exterior surface 64.

Having illustrated and described the principles of my invention in a preferred embodiment thereof, it should be readily apparent to those skilled in the art that the invention can be modified in arrangement and detail without departing from such principles.

I claim all modifications coming within the spirit and scope of the accompanying claims:

1. A gold club grip comprising:

a pair of elongate sections substantially equal in length, together defining an interior channel sized for engagingly receiving a golf club shaft, the top end of the shaft being covered by the grip;

hinge means connected to each of the elongate sections for pivotally opening and closing the sections; and locking means connected to each said sections for releasably securing the sections in mating relation to each other to lock the grip onto the shaft for forming a unitary golf club grip, said locking means including a first flange having an L-shaped cross-section connected along the end of a first one of said sections and extending axially outward away from said interior channel; and a second flange having an L-shaped cross-section connected along a corresponding end of the other one of said sections and extending axially inward toward said interior channel; said first flange and said second flange sized and positioned relative to each other to interlockingly engage each other to releasably secure the sections to each other and form a substantially continuous external surface of the grip.

2. A golf club grip according to claim 1, wherein the sections are formed in a single piece grip including an hinge means integral with said single piece grip for opening and closing the sections; and the elongate sections together form a substantially continuous exterior surface of the grip when secured in mating relation.

3. A golf club grip according to claim 2, wherein a polymeric material is thinned in a region adjacent the interconnection of the sections to form said hinge means.

4. A golf club grip according to claim 1, the locking means including:

at least one flange positioned along an elongate end of each of said sections; and at least one channel means corresponding in number to the number of said flanges, each channel in an elongate end opposite to said corresponding flange being sized and positioned to receive and interlockingly and releasingly secure said correspondingly opposite flange, to maintain said grip in position on the shaft and to form a substantially continuous external surface of the grip.

5. A golf club grip according to claim 1 wherein the flanges extend along substantially the entire length of the sections.

6. A golf club grip according to claim 1 wherein the sections together define at least one slot when the sections are secured in said mating relation with each other, the slot positioned in communication with the locking means and sized to receive a means for releasing the locking means.

7. A golf club grip according to claim 1 wherein the sections are formed to define a substantially flat top end of the grip; and said interior channels terminating at a position spaced apart from the top end of the grip so that the top end of the grip covers the end of the shaft.

8. A golf club grip according to claim 7 wherein the sections are formed to define a pair of substantially flat faces on the exterior of the grip positioned adjacent each other and substantially normal to each other.

9. A plurality of golf club grips according to claim 1, including at least one grip exhibiting a color different from the color of another grip in the set.

10. The golf club grip of claim 1, which is made of a polymeric material.

11. A golf club comprising:

a head for striking a golf ball;

an elongate shaft having top and bottom ends connected at the bottom end to the head for moving the head; and a grip, releasably secured to the shaft so as to cover the top end of the shaft and a portion of the shaft adjacent the top end for gripping the shaft, said grip including locking means for releasably locking the grip in frictional engagement on the shaft, said locking means including a first flange having an L-shaped cross-section connected to the end of a first one of said sections and extending outwardly therefrom; and a second flange having a L-shaped cross-section connected to the end of the other one of said sections and extending inwardly therefrom; said first flange and said second flange sized and positioned relative to each other to interlockingly engage each other to releasably secure the sections to each other and form a substantially continuous external surface of the grip.

12. A golf club according to claim 11 wherein the grip is formed of an impact-resistant, flexible polymeric material.

13. A golf club according to claim 11 wherein the grip includes two elongate sections, said sections pivotally connected together for opening and closing the grip.

14. A golf club grip according to claim 13, wherein the sections are formed in a single piece grip including an hinge means integral with said single piece grip for opening and closing the sections.

* * * * *